US011377982B2

(12) United States Patent
Lawes et al.

(10) Patent No.: US 11,377,982 B2
(45) Date of Patent: Jul. 5, 2022

(54) ROTARY VALVE INTERNAL COMBUSTION ENGINE

(71) Applicant: RCV ENGINES LIMITED, Wimborne (GB)

(72) Inventors: Keith Lawes, Wimborne (GB); Brian Mason, Wimborne (GB)

(73) Assignee: RCV ENGINES LIMITED, Wimborne (GB)

( * ) Notice: Subject to any disclaimer, the term of this patent is extended or adjusted under 35 U.S.C. 154(b) by 0 days.

(21) Appl. No.: 17/272,867

(22) PCT Filed: Sep. 4, 2019

(86) PCT No.: PCT/EP2019/073575
§ 371 (c)(1),
(2) Date: Mar. 2, 2021

(87) PCT Pub. No.: WO2020/049040
PCT Pub. Date: Mar. 12, 2020

(65) Prior Publication Data

US 2021/0317761 A1 Oct. 14, 2021

(30) Foreign Application Priority Data

Sep. 6, 2018 (GB) ..... 1814488
Sep. 6, 2018 (GB) ..... 1814524

(51) Int. Cl.
*F01L 7/02* (2006.01)
*F01L 7/16* (2006.01)

(52) U.S. Cl.
CPC ..... *F01L 7/022* (2013.01); *F01L 7/029* (2013.01); *F01L 7/16* (2013.01); *F01L 2250/06* (2013.01)

(58) Field of Classification Search
CPC ... F01L 7/022; F01L 7/029; F01L 7/16; F01L 2250/06; F01L 7/028; F01L 7/08; F01L 7/021; F01M 13/02; F01M 2013/0038
See application file for complete search history.

(56) References Cited

U.S. PATENT DOCUMENTS 473,685 A 4/1892 Weiss
2,146,528 A * 2/1939 Chilton ..... F01L 7/028 251/310

FOREIGN PATENT DOCUMENTS

DE 320652 C 11/1951
DE 4040936 A1 6/1992
(Continued)

OTHER PUBLICATIONS

International Search Report dated Oct. 23, 2019, for International Patent Application No. PCT/EP2019/073575.

*Primary Examiner* — Jacob M Amick
*Assistant Examiner* — Charles J Brauch
(74) *Attorney, Agent, or Firm* — Karceski IP Law, PLLC

(57) ABSTRACT

A rotary valve internal combustion engine has a piston connected to a crankshaft, where the piston is reciprocatable in a cylinder, and a combustion chamber being defined in part by the piston. The engine has a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing. The valve body has a non-uniform radial profile along its axial length and/or about its axis of rotation to accommodate changes in the profile of the valve body during operation to maintain a substantially constant clearance between the
(Continued)

valve body and the housing throughout the length of the valve body.

7 Claims, 3 Drawing Sheets

(56) References Cited

FOREIGN PATENT DOCUMENTS

| | | | | | |
|---|---|---|---|---|---|
| DE | 4217608 | A1 | | 4/1993 | |
| GB | 584829 | A | * | 1/1947 | ..... F01L 7/08 |
| GB | 2467947 | A | | 8/2010 | |

* cited by examiner

ROTARY VALVE INTERNAL COMBUSTION ENGINE

CROSS-REFERENCE TO RELATED APPLICATION(S)

This is a National Stage Entry into the United States Patent and Trademark Office from International Patent Application No. PCT/EP2019/073575, filed on Sep. 4, 2019, which relies on and claims priority to United Kingdom Patent Application No. GB 1814488.1, filed on Sep. 6, 2018, and United Kingdom Patent Application No. 1814524.3 filed, on Sep. 6, 2018, the entire contents of all of which are incorporated herein by reference.

FIELD OF THE INVENTION

The present invention relates to a rotary valve internal combustion engine in which the control of the intake and exhaust of combustion gases is achieved by means of a rotary valve.

DESCRIPTION OF THE RELATED ART

Such rotary valves are known, for example in the applicant's Patent No. GB 2467947B. Rotary valve engines are known to have problems of sealing as there is a conflict between minimizing the clearances between the relatively rotating bodies, which improves efficiency, but runs the increasing risk of overheating and seizing. Attempts have been made for many years to make a commercially acceptable engine utilizing rotary valves, notably by Aspin, but these have mostly been unsuccessful. In the prior art, such as DE 4217608 A1 and DE 4040936 A1, this conflict is recognized and attempts to solve the problem are made by providing complex cooling arrangements or simply saying the problem is solved by using suitable materials. In practice, larger than desired clearances are provided to reduce the risk of seizing, at the cost of reducing the efficiency of the engine and increased emissions, which creates difficulties in meeting current regulations and customer expectations.

There is an inherent problem in reducing the gap because of the differential thermal expansion between the rotary valve body and the valve housing caused, in part, by the higher temperatures that the rotary valve body reaches compared to the valve housing. This is caused in part by the fact that the valve body is located in the combustion chamber at the point of maximum temperature generation, and also has poorer thermal pathways through which to conduct the heat away to the outside world. In contrast the valve housing has the advantage that it is able to conduct the heat away directly by the provision of external cooling means such as fins or water cooling.

SUMMARY OF THE INVENTION

The present invention seeks to provide means to overcome the known problems.

According to the present invention there is provided a rotary valve internal combustion engine comprising: a piston connected to a crankshaft which piston reciprocates in a cylinder, the cylinder having a combustion end, a combustion chamber being defined in part by the piston and the combustion end of the cylinder, a valve housing fixed at an outer portion of the combustion end of the cylinder and defining a bore and a generally cylindrical rotary valve rotatable about a rotary valve axis with a close sliding fit in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing, a sealing function being carried out between the surface of the main body of the rotary valve and a contiguous surface of the bore in the valve housing, wherein the sealing function is carried out between the surface of the body of the rotary valve and the surface of the valve housing only, wherein the valve body has a non-uniform radial profile along its axial length and/or about its axis of rotation to accommodate changes in the profile of the valve body during operation generated by the temperature gradient along the length of the valve body, thereby to maintain a substantially constant clearance between the valve body and the housing throughout the contiguous length of the valve body.

In a preferred embodiment, the valve body is tapered along its axial extent with the diameter of the valve at its open end in the combustion chamber being smaller at ambient temperature than the diameter at its end remote from the combustion chamber to accommodate changes in the profile of the valve body during operation.

The valve body may be frusto-conical along at least part of its length.

Preferably, in another embodiment, the valve has a concentric driveshaft mounted in the valve housing so as to allow a slight degree of radial movement of the valve in the valve housing so that the valve acts as an active seal valve.

In this embodiment, the end of the valve driveshaft adjacent the valve body has a reduced diameter to allow said slight degree of radial movement of the valve in the valve housing.

In a further embodiment, there is shown a rotary valve internal combustion engine comprising: a piston connected to a crankshaft which piston reciprocates in a cylinder, the cylinder having a combustion end, a combustion chamber being defined in part by the piston and the combustion end of the cylinder, a valve housing fixed at an outer portion of the combustion end of the cylinder and defining a bore and a generally cylindrical rotary valve rotatable about a rotary valve axis with a close sliding fit in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing, a sealing function being carried out between the surface of the main body of the rotary valve and a contiguous surface of the bore in the valve housing, wherein the sealing function is carried out between the surface of the body of the rotary valve and the surface of the valve housing only, wherein the valve body has a constant diameter along its length contiguous with the valve housing and the valve housing has a non-uniform radial profile along its axial length and/or about its axis of rotation to accommodate changes in the profile of the valve body during operation generated by the temperature gradient along the length of the valve body, thereby to maintain a substantially constant clearance between the valve body and the housing throughout the contiguous length of the valve body.

BRIEF DESCRIPTION OF THE DRAWINGS

Preferred embodiments of the present invention will now be described by way of example with reference to the accompanying drawings, in which.

DETAILED DESCRITION OF EMBODIMENT(S) OF THE INVENTION

Figure 1:
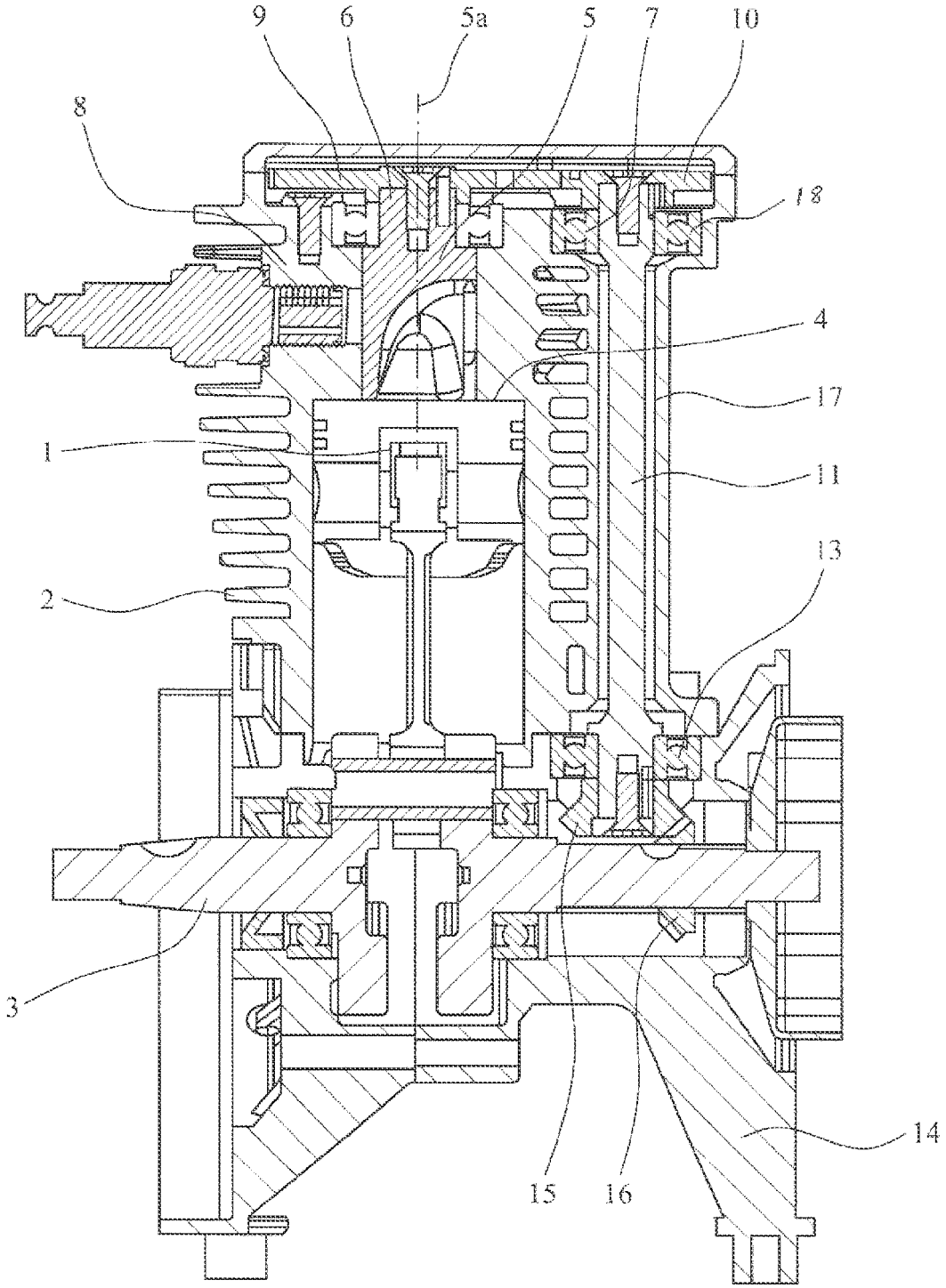
FIG. 1 shows a cross-sectional view of a single cylinder air cooled engine.

Referring now to FIG. 1, there is shown a single cylinder air cooled engine. The engine has a cylinder housing containing the cylinder 2. A piston 1 is connected in the conventional manner to a crankshaft 3 mounted for rotation in a crankcase 14 for reciprocation in the cylinder 2. The upper part of the cylinder 2 is closed by a combustion chamber 4 in a combustion chamber housing. The flow of inlet air/fuel mix and exhaust gas into and out of the combustion chamber 4 is controlled by a rotary valve 5. In this embodiment, the valve 5 is rotatable in a valve housing 8 in the combustion chamber housing about an axis 5*a* which is co-axial with the axis of the cylinder 2. In other embodiments, the axis of rotation of the valve body is offset from the axis 5*a* of the cylinder 2.

At its end remote from the combustion chamber 4, the rotary valve 5 has a concentric drive shaft 6 carrying a single race ball bearing 7 which rotatably supports the valve 5 in the valve housing 8. The valve driveshaft 6 is secured to a coaxial driven gear 9 which meshes with a drive gear 10 of a drive arrangement 1 1 through which the driven gear 9 and hence the rotary valve 5 is connected to the crankshaft 3. The drive arrangement 1 1 includes a drive shaft 12 which is located in a channel or tube 17 in the cylinder housing and mounted for rotation in an upper bearing 18 adjacent the drive gear 10 and a lower bearing 13 adjacent the crankshaft 3. The driveshaft 1 1 carries a bevel gear 15 which meshes with a corresponding bevel gear 16 secured on the crankshaft for rotation with the crankshaft 3. Thus, the rotation of the crankshaft 3 and hence the piston movement is coordinated with the rotation of the rotary valve 5 so that the engine operates on the conventional four stroke cycle. To achieve this, the diameter of the driven gear 9 is twice that of the drive gear 10 so that the rotary valve 5 rotates at half engine speed.

Figure 2:
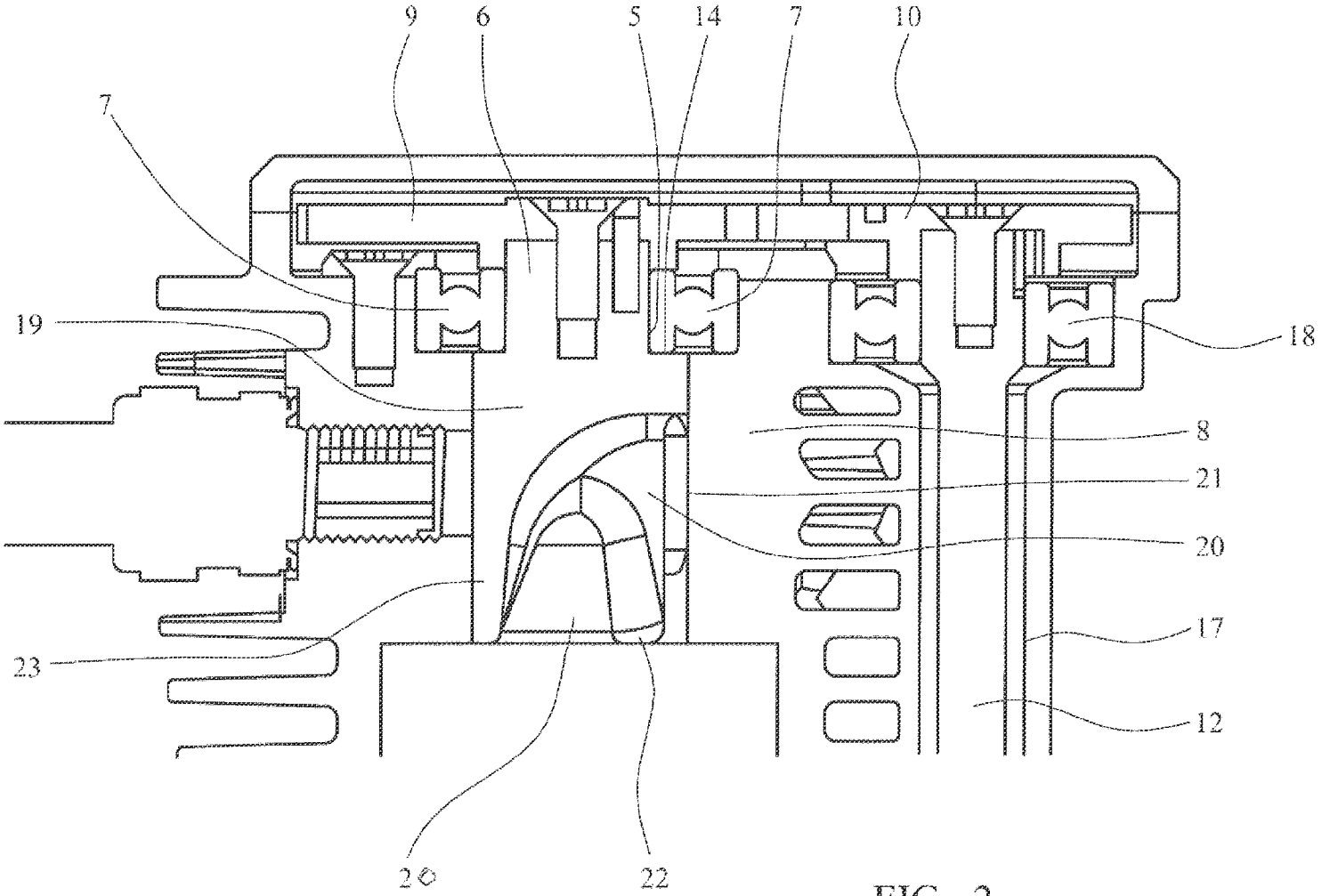
FIG. 2 is a schematic view of one embodiment of the rotary valve body.

Referring now to FIG. 2 also, there is shown more detail of the rotary valve 5 which comprises a generally cylindrical rotary valve body 5 rotatable about a rotary valve axis 5*a* with a close sliding fit in the bore in the valve housing 8, the rotary valve 5 having a hollow valve body having an interior volume 19 forming a part of the combustion chamber. The valve has a generally cylindrical body part comprising the valve body 19 itself which is slightly larger in diameter than the shaft 6, which forms a shoulder 14 against which the inner race of the ball bearing 7 is located. The valve body 19 extends into the combustion chamber and has in its interior a volume 20 which forms part of the combustion chamber 4 and which is subject to combustion gases at all stages of the combustion process. The valve body 19 is rotatable in the bore in a valve housing 8 with a close sliding fit. The valve body has a nonuniform profile along its axial length and/or about its axis of rotation to accommodate changes in the profile of the valve body during operation. In this embodiment, the diameter of the valve body is tapered in a frusto-conical manner and at ambient temperatures has a smaller diameter at the lower peripheral edge 22 of the wall 23 of the valve body which projects into the combustion chamber. The taper is designed to compensate for differing expansion of the valve along its axial length in use caused principally by the temperature gradient along the length of the valve which occurs in practice. In this way, in normal operating conditions, the peripheral gap between the valve body and the bore in which it rotates remains substantially constant throughout the length of the valve body. Furthermore, the rotational cross-section of the valve body may be non-uniform to accommodate variations in temperature across the diameter of the valve such as may occur in the region of the peripheral edges of the port 21. These edges may have a slightly smaller diametral extent to compensation for the heat concentration which inevitably occurs at such edges. These measures effectively eliminate the risk of seizing of the engine due to local hot spots which may occur, for example, at these edges. Although described as having a tapered body, the taper may not be uniform throughout the length of the valve, but will be determined by the actual temperature gradient along the axial extent of the valve which occurs in normal use.

This embodiment has a constant diameter for the bore in the housing with the shaping being carried out on the valve, body but it will be understood that the valve body may be cylindrical with the bore in the housing having a shaped profile. Because of the different heat dissipation characteristics of the housing compared with the valve body, the shaping of the housing will be different from the shaping necessary when it is on the valve body. The objective is to ensure that the clearance between the valve body and the housing is kept as constant, and as small, as possible throughout its length to maximize the engine efficiency for maximum power and at the same time minimizing its emissions. The valve 5 and the valve housing 8 are formed of aluminum.

The shaft 6 part of the rotary valve 5 is only slightly smaller in diameter than the valve body 19 to provide the shoulder 14. The shaft is solid to provide a good path for conducting heat from the valve body 19 to the exterior. Adjacent the shoulder 14, the shaft 6 has a slight undercut to enable slight radial movement of the valve body so that during the combustion stages the combustion pressure when it is high, serves to bias the valve port towards the outlet port in the valve housing so that the valve acts as an active seal reducing gas leakage.

The rotary valve body 19 has a port 21 which, during rotation of the valve, enables fluid communication successively to and from the interior volume of the valve and hence the combustion chamber via inlet and exhaust ports in the valve housing. In this embodiment the port is in the form of a recess formed in the lower peripheral edge 22 of the wall 23 of the valve body adjacent to the combustion chamber 4 the recess extending upwardly from this lower edge of the wall of the valve to form the port 21 in the side of the valve.

In the present embodiment, it is the profile of the valve body which is non-uniform which rotates in a uniform cylindrical bore in the valve housing. In an alternative construction it is possible for the profile of the valve body to be a uniform constant diameter cylindrical form with the non-uniform profile being formed in the bore in the valve housing.

Although described as a single cylinder engine, it will be understood that the invention is equally applicable to multi cylinder engines which may be of in-line, Vee or horizontally opposed configuration. Furthermore, although described as a spark ignition engine the invention is equally applicable to a compression ignition engine.

Although the example given is for an engine with the axis of rotation of the rotary valve coaxial with or parallel to the axis of the cylinder, it will be understood that axis of rotation of the valve could be angularly offset from the axis of the cylinder. The invention is equally applicable to rotary valve engines where the axis of rotation of the valve is parallel to the axis of rotation of the crankshaft, or indeed at any intermediate angle.

According to a further embodiment, there is provided a rotary valve internal combustion engine operating on the four stroke cycle comprising: a piston connected to a crankshaft located in a crankcase which piston reciprocates in a cylinder, the cylinder having a combustion end, a combustion chamber being defined in part by the piston and the combustion end of the cylinder, a valve housing fixed at an outer portion of the combustion end of the cylinder and defining a bore and a rotary valve rotatable about a rotary valve axis in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing wherein a fluid passage is provided between the inlet port and the crankcase.

Preferably, a carburetor is connected to the inlet tract to provide a fuel air mix to the inlet tract, the fluid passage being connected to the inlet tract downstream of the carburetor. The fluid passage may comprise a pipe.

The further embodiment will now be described by way of example with reference to FIG. 3 which shows a perspective view of the underside of the engine of FIG. 1.

Figure 3:
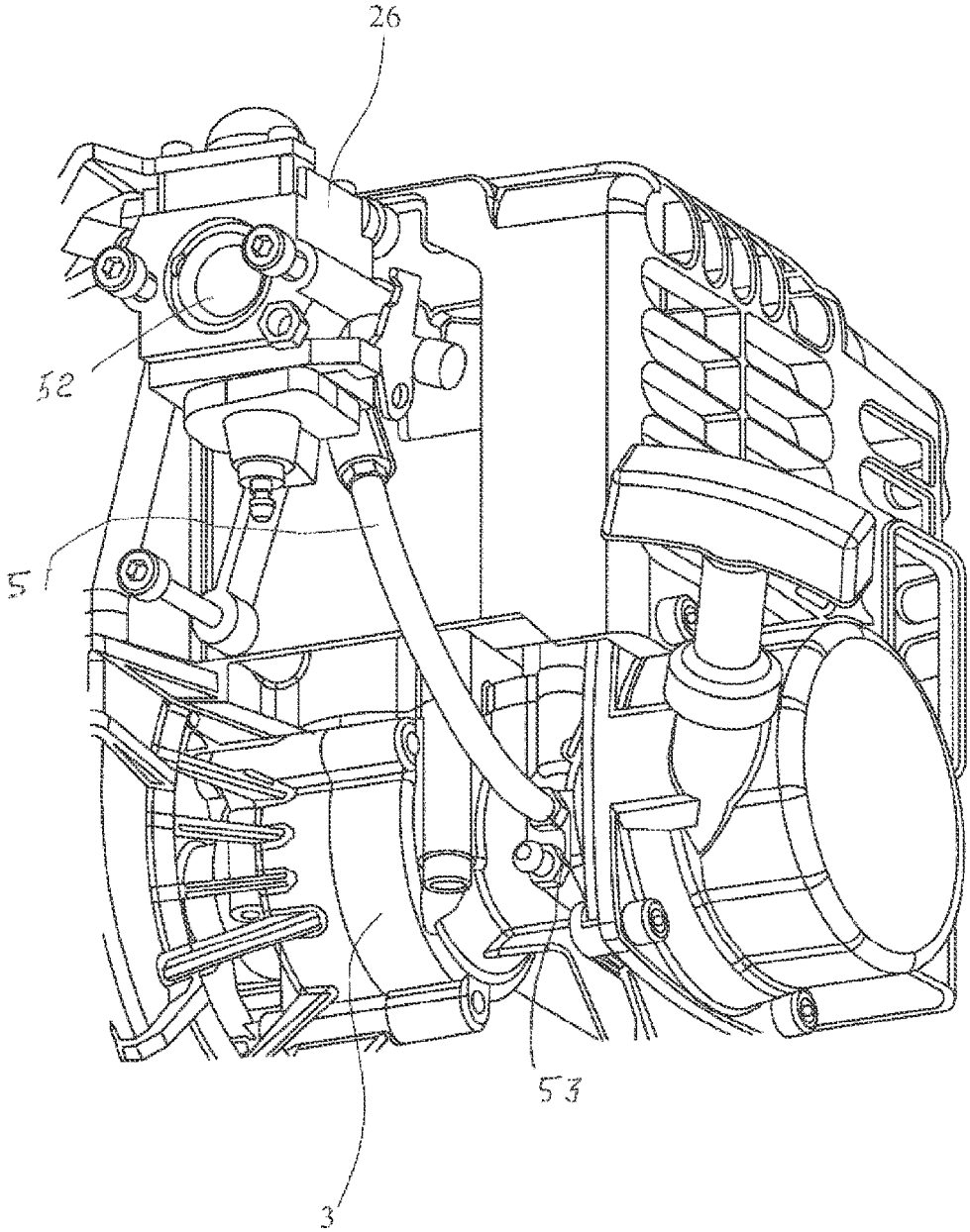
FIG. 3 is a perspective view of the underside of the engine of FIG. 1.

Referring now to FIG. 3 there is shown a perspective underside view of the engine according to FIG. 1 showing the crankcase 3 and a carburetor 26 connected to an inlet tract 52 downstream of the carburetor 26 and hence to a fluid connection to the inlet port 27 of the engine. A fluid connection between inlet tract 52 and the crankcase 3 is formed by a pipe 51 which is connected to the crankcase 3 by a connection 53 adjacent to the bevel gears 15, 16 of the drive arrangement 11.

The fluid connection between the crankcase and the inlet tract allows blow-by gases in the crankcase generated by leakage of combustion gases past the piston during combustion, to be vented into the inlet tract and hence to the inlet port 27. In operation, during each upward stroke of the piston a negative pressure is generated in the crankcase caused by the increase in crankcase volume and this will draw a small amount of inlet gas from the inlet tract into the crankcase. This inlet gas will mix with the crankcase gases. During each downward stroke of the piston which reduces the crankcase volume, a small amount of the crankcase gas will be expelled into the inlet tract. This will allow an equilibrium between inlet mixture and crankcase mixture to build up in the crankcase ensuring the lubrication of the crankcase.

The invention claimed is:

1. A rotary valve internal combustion engine, comprising:

a piston connected to a crankshaft, wherein the piston reciprocates in a cylinder having a combustion end, a combustion chamber being defined in part by the piston and the combustion end of the cylinder, a valve housing fixed at an outer portion of the combustion end of the cylinder and defining a bore, a generally cylindrical rotary valve disposed in the valve housing, wherein the rotary valve is rotatable about a rotary valve axis with a close sliding fit in the bore in the valve housing, wherein the rotary valve has a hollow valve body having an interior volume forming a part of the combustion chamber, wherein the interior volume of the hollow valve body is subjected to combustion gases throughout the combustion process, wherein the rotary valve has, in a wall part thereof, a port giving, during rotation of the rotary valve, fluid communication successively to and from the combustion chamber via inlet and exhaust ports in the valve housing, wherein a sealing function is carried out between a surface of a main body of the rotary valve and a contiguous surface of the bore in the valve housing, and wherein the sealing function is carried out by a non-uniform profile between the valve housing and the main body determined by a temperature gradient along at least a portion of an axial length of the main body during operation, thereby maintaining a substantially constant clearance between the main body and the valve housing throughout the axial length of the main body.

2. The rotary valve internal combustion engine according to claim 1, wherein the main body is tapered axially, with a diameter of the rotary valve at an open end in the combustion chamber being smaller at ambient temperature than the diameter at an end remote from the combustion chamber to accommodate changes in the profile of the main body during operation.

3. The rotary valve internal combustion engine according to claim 1, wherein the main body is frusto-conical along at least part of the axial length.

4. The rotary valve internal combustion engine according to claim 1, wherein the rotary valve has a concentric driveshaft mounted in the valve housing so as to allow a slight degree of radial movement of the rotary valve in the valve housing so that the rotary valve acts as an active seal valve.

5. The rotary valve internal combustion engine according to claim 4, wherein an end of the driveshaft adjacent the main body has a reduced diameter to allow the slight degree of radial movement of the rotary valve in the valve housing.

6. The rotary valve internal combustion engine according to claim 1, wherein the main body has a uniform profile along the axial length and the bore in the valve housing has a non-uniform profile along the axial length of the main body.

7. The rotary valve internal combustion engine according to claim 1, wherein the main body has a non-uniform profile along the axial length and the bore in the valve housing has a uniform profile along the axial length of the main body.

* * * * *